US006945857B1

(12) United States Patent
Doan et al.

(10) Patent No.: US 6,945,857 B1
(45) Date of Patent: Sep. 20, 2005

(54) POLISHING PAD CONDITIONER AND METHODS OF MANUFACTURE AND RECYCLING

(75) Inventors: Trung Doan, Los Gatos, CA (US); Venkata R. Balagani, Gilroy, CA (US); Kenny King-Tai Ngan, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/888,941

(22) Filed: Jul. 8, 2004

(51) Int. Cl.[7] ..... B24B 1/00

(52) U.S. Cl. ..... 451/56; 451/72; 451/443; 451/539

(58) Field of Search ..... 451/54, 56, 67, 451/72, 443, 526, 534, 539

(56) References Cited

U.S. PATENT DOCUMENTS

| | | | | |
|---|---|---|---|---|
| 3,743,489 | A | 7/1973 | Wentorf et al. | |
| 3,767,371 | A | 10/1973 | Wentorf et al. | |
| 4,062,660 | A | 12/1977 | Nicholas et al. | |
| 4,225,322 | A | 9/1980 | Knemeyer | |
| 4,661,180 | A | 4/1987 | Frushour | |
| 5,643,052 | A | 7/1997 | Delattre et al. | |
| 6,159,087 | A | 12/2000 | Birang et al. | |
| 6,200,199 | B1 | 3/2001 | Gurusamy et al. | |
| 6,300,223 | B1 | 10/2001 | Chang et al. | |
| 6,322,427 | B1 | 11/2001 | Li et al. | |
| 6,325,709 | B1 | 12/2001 | Nanda et al. | |
| 6,341,997 | B1 | 1/2002 | Lin et al. | |
| 6,361,423 | B2 | 3/2002 | Gurusamy et al. | |
| 6,476,488 | B1 | 11/2002 | Jeng et al. | |
| 6,524,357 | B2 | 2/2003 | Baldoni et al. | |
| 6,540,597 | B1 * | 4/2003 | Ohmori | 451/443 |
| 6,551,176 | B1 | 4/2003 | Garretson | |
| 6,632,127 | B1 | 10/2003 | Zimmer et al. | |
| 2002/0127962 | A1 * | 9/2002 | Cho et al. | 451/443 |

* cited by examiner

*Primary Examiner*—Jacob K. Ackun, Jr.
(74) *Attorney, Agent, or Firm*—Janah & Associates

(57) ABSTRACT

A recycled polishing pad conditioner comprises a base plate and a reversed abrasive disc that is flipped over from its original configuration. The reversed disc comprises an exposed abrasive face having an unused abrasive face comprising abrasive particles. A bond face of the disc is affixed to the base plate, the bond face comprising a used abrasive face that was previously used to condition polishing pads. Also described is a pad conditioner having an abrasive face comprising exposed portions of abrasive particles, with at least about 60% of the abrasive particles having a crystalline structure with substantially the same crystal symmetry.

20 Claims, 7 Drawing Sheets

FIG. 1
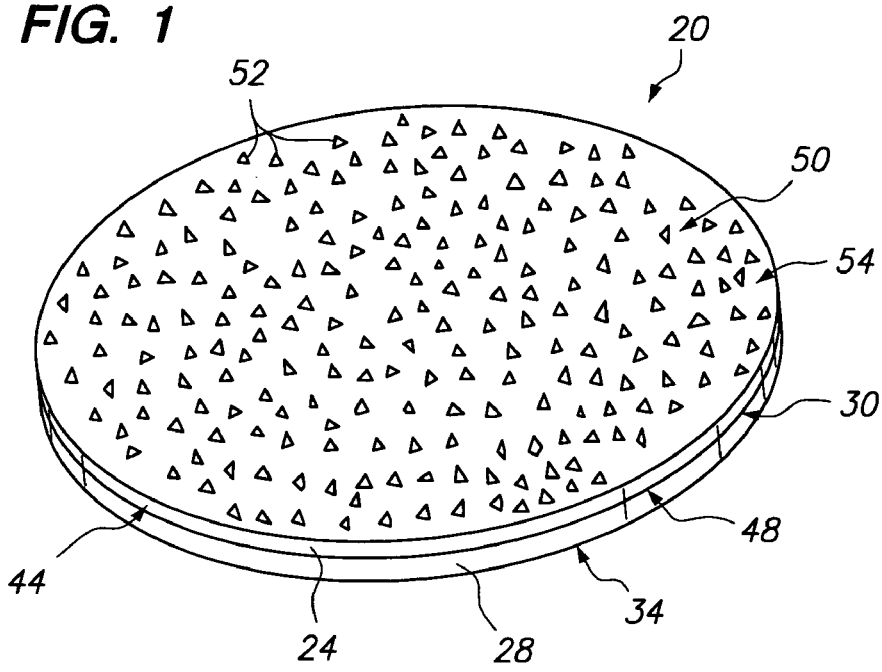
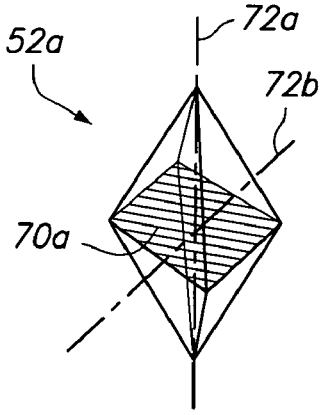
FIG. 2A
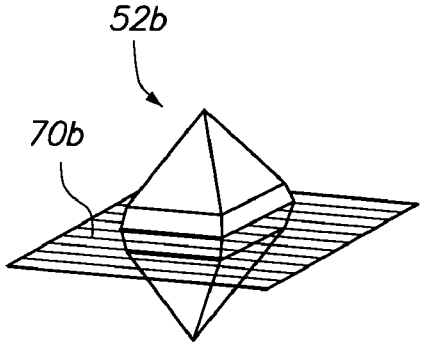
FIG. 2B
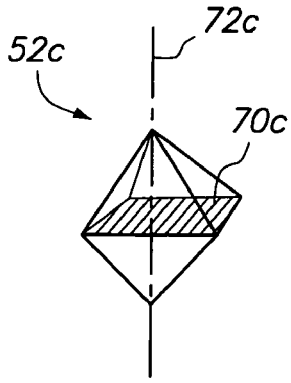
FIG. 2C

POLISHING PAD CONDITIONER AND METHODS OF MANUFACTURE AND RECYCLING

BACKGROUND

Embodiments of the present invention relate to a polishing pad conditioner and methods of manufacturing and recycling.

In the fabrication of the integrated circuits (ICs) and displays, chemical-mechanical planarization (CMP) is used to smoothen the surface topography of a substrate for subsequent etching and deposition processes. A typical CMP apparatus comprises a polishing head that oscillates and presses a substrate against a polishing pad while a slurry of abrasive particles is supplied to polish the substrate. CMP can be used to planarize dielectric layers, deep or shallow trenches filled with polysilicon or silicon oxide, and metal films. It is believed that CMP polishing typically occurs as a result of both chemical and mechanical effects, for example, a chemically altered layer is repeatedly formed at the surface of the material being polished and then polished away. For instance, in metal polishing, a metal oxide layer can be formed and removed repeatedly from the surface of the metal layer during CMP polishing.

However, during the CMP process, the polishing pad collects polishing residue containing ground-off particulate material and slurry by-product. Over time, the polishing residue clogs up the polishing surface of the pad resulting in a glazed polishing pad surface that does not effectively polish the substrate and can even scratch the substrate. For example, in oxide planarization, rapid deterioration in oxide polishing rates with successive substrates results from pad glazing because the polishing surface of the polishing pad becomes smooth and no longer holds slurry between its fibers or grooves, or pores of the pad become clogged with debris. This is a physical phenomenon on the pad surface not necessarily caused by any chemical reactions between the pad and the slurry.

To remedy pad glazing, the pad is periodically conditioned during CMP polishing to restore its original properties by removing polishing residues and re-texturizing the pad surface. A pad conditioner having a conditioning surface with abrasive particles, such as diamond particles, is rubbed against the used polishing surface of the polishing pad to condition the pad surface by removing polishing debris, un-clogging pores on the polishing surface, and forming micro-scratches in the surface of the pad to retain slurry. The pad conditioning process can be carried out either during a polishing process, i.e. known as concurrent conditioning, or after a polishing process.

However, conventional pad conditioners can vary in conditioning ability when the abrasive particles on the pad have physically different structures. For example, when the abrasive particles have different heights, they can cause uneven grooves to be formed on the polishing pad surface. Deeper grooves result in the retention of excessive slurry in the grooves which can cause the substrate portions exposed to those grooves to become excessively eroded. Abrasive particles have been sorted by sizes to reduce these effects, but they are still prevalent in many polishing pad conditioners. Thus it is desirable to have a pad conditioner with a polishing surface that provides uniform and repeatable polishing characteristics even after polishing a number of substrates.

Furthermore, as the pad conditioner is repeatedly used to condition the polishing pad, its effectiveness at reconditioning the polishing surface of the polishing pad gradually decreases because the abrasive particles become worn out and rounded. The abrasive particles of the used conditioner pad can also eventually loosen and fall out. When too many abrasive particles are lost from a region of the conditioning surface, the pad conditioner begins to condition the polishing pad unevenly. The loose abrasive particles can also become embedded in the polishing pad and scratch the substrate during polishing.

Once worn out, the abrasive face of conventional pad conditioners cannot be easily refurbished. The lost abrasive particles cannot be easily replaced with new particles because a relatively strong bond is required between the particles and surrounding matrix, which is difficult to achieve on a used conditioning surface. Thus, in time, when a substantial number of abrasive particles are either worn or lost, the conditioning ability of the pad conditioner so deteriorates that it must be replaced with a new pad conditioner, usually at significant cost. The worn or damaged pad conditioners also result in lower yields from the substrates being polished.

Accordingly, it is desirable to have a pad conditioner that provides more uniform and repeatable polishing characteristics from one polishing pad to another. It is also desirable to have pad conditioners with polishing surfaces that have controllable and reproducible abrasive properties. It is further desirable to be able to recondition the abrasive face of a used pad conditioner. It is also desirable to be able to reuse or recycle pad conditioners, especially when the abrasive particles are expensive or difficult to manufacture.

SUMMARY

According to one embodiment of the present invention, a recycled polishing pad conditioner comprises a base plate and a reversed abrasive disc. The abrasive disc comprises an exposed abrasive face having an unused abrasive face comprising abrasive particles, and a bond face affixed to the base plate, the bond face comprising a used abrasive face that was previously used to condition polishing pads.

In another embodiment, a used polishing pad conditioner is recycled. The used pad conditioner comprises a base plate and an abrasive disc having (i) an original bond surface bonded to the base plate, and (ii) a used abrasive face that was previously used to condition polishing pads. The abrasive disc is removed from the base plate and reversed to expose the original bond surface of the disc. The used abrasive face is then bonded to the base plate and unused abrasive particles on the original bond surface are exposed to form a fresh abrasive face on a recycled pad conditioner.

In another embodiment of the present invention, a polishing pad conditioner comprises a base plate and an abrasive disc having an abrasive face comprising exposed portions of abrasive particles, where at least about 60% of the abrasive particles have a crystalline structure with substantially the same crystal symmetry. By same crystal symmetry it is meant that the particles are substantially symmetrical in crystalline structure about a mirror plane or axis through the particles.

In a further embodiment, a chemical mechanical apparatus comprising the pad conditioner has a polishing station comprising a platen to hold a polishing pad. A substrate holder is provided to hold a substrate against the polishing pad. A drive is provided to power the platen or substrate holder. A slurry dispenser dispenses slurry on the polishing pad. A conditioner head is provided to receive the pad conditioner. A drive powers the conditioner head so that the abrasive face of the pad conditioner can be rubbed against the polishing pad to condition the pad.

DRAWINGS

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

FIG. 1 is a perspective view of a pad conditioner;

FIGS. 2A to 2C are perspective views of different types of symmetrical abrasive particles;

DESCRIPTION

Figure 3:
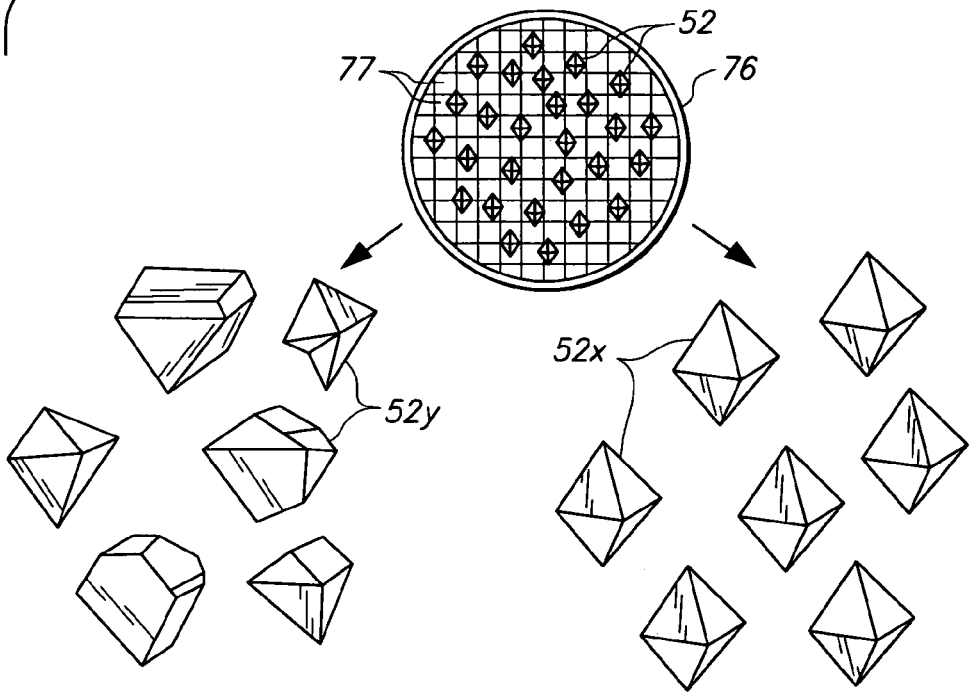
FIG. 3 is a schematic illustration of segregation of symmetric abrasive particles from asymmetric particles with a mesh sieve.

A polishing pad conditioner 20 typically includes an abrasive disc 24 attached to a base plate 28, as shown in FIG. 1. Generally, the base plate 28 is a support structure, such a carbon steel plate, which provides structural rigidity to an abrasive disc 24. However, other rigid materials, such as acrylic, polycarbonate, or aluminum oxide can also be used. The base plate 28 has a front face 30 and a back face 34 with two countersunk screw holes 32*a, b*, as shown in FIG. 4B, to allow a pair of screws or bolts to be inserted therein to hold the base plate 28 to a conditioner head of a CMP polisher. Alternatively, the base plate 28 can also have a locking socket (not shown) centered on a back face 34 that is capable of locking to the conditioner head. While illustrative embodiments of the pad conditioner are described herein, it should be understood that other embodiments are also possible, and thus the scope of the claims should not be limited to these illustrative embodiments.

The abrasive disc 24 can be a separate structure that is affixed on the front face 30 of the base plate 28, or the abrasive disc 24 and base plate 28 can form an integral and unitary structure. Generally, the abrasive disc 24 comprises a planar body 44 having a bond face 48 that is bonded to the front face 30 of the base plate 28, and an exposed abrasive face 50 having embedded abrasive particles 52. The planar body 44 comprises a matrix 54 that supports and holds the abrasive particles 52. For example, the matrix 54 can be made of a metal alloy, such as a nickel or cobalt alloy, which is coated on the abrasive disc 24, and the abrasive particles 52 subsequently embedded in the heat softened coating. The abrasive particles 52 can also be positioned on the front face of the base plate 28, and thereafter, an alloy material infiltrated between the abrasive particles 52 in a high temperature, high-pressure fabrication process, to form an abrasive disc 24 that is pre-bonded to the base plate 28.

Figure 4A:
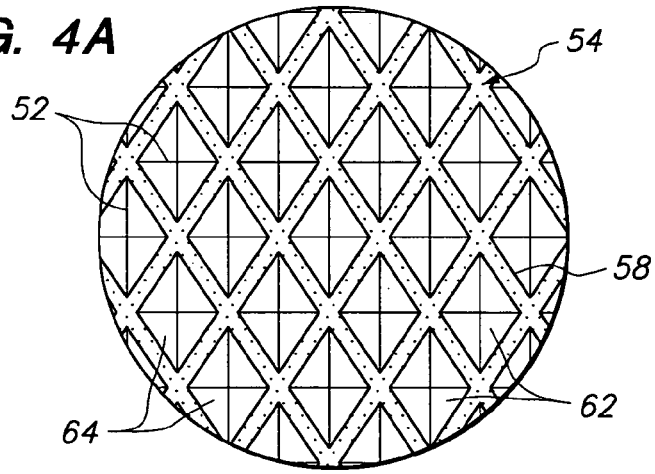
FIG. 4A is a top view of a section of a mesh having grid spacings with symmetric abrasive particles lodged in the grid spacings.
Figure 4B:
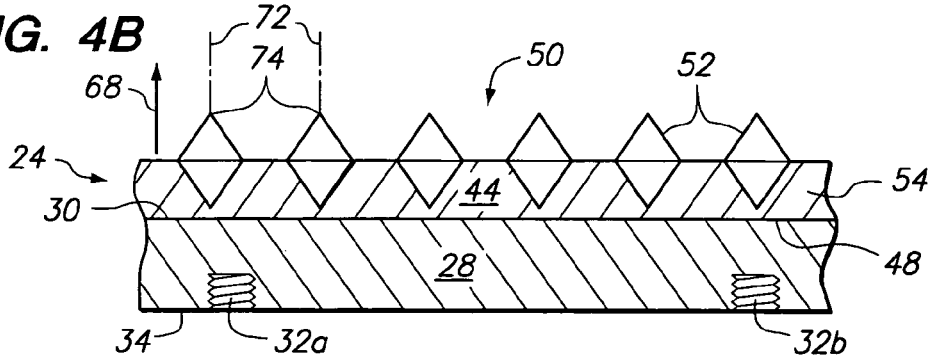
FIG. 4B is a partial sectional view of the mesh of FIG. 4A showing symmetric particles arranged in the grid spacings of the mesh.

In one version, the matrix 54 comprises a mesh 58 having a grid 62 in which the abrasive particles 52 are embedded to fix their positions relative to one another along the X-Y plane of the grid, as shown in FIGS. 4A and 4B, and described in commonly assigned U.S. Pat. No. 6,159,087 to Birang et al, which is incorporated herein by reference in its entirety. Each grid space 64 is set-up to provide a predetermined grid spacing between the center-points of the abrasive particles 52. The grid 62 fixes the relative positions of the abrasive particles 52 so that the particles 52 are approximately separated by equal distances in any direction along the X-Y plane. The grid 62 may be a wire mesh, such as a nickel wire, or a polymer string mesh.

When the abrasive disc 24 is be formed as a separate structure, one side of the disc 24 has a bond face 48 capable of being bonded to the base plate 28 to form a secure bond that will not easily dislodge or loosen from the strong frictional forces that are generated when the pad conditioner 20 is pressed against a polishing pad of a CMP polisher. The bond face 48 is typically relatively smooth or slightly roughened with grooves, so it can be easily attached to the base plate 28. When the abrasive disc 24 comprises a metal matrix 54 surrounding the abrasive particles 52, the planar body 44 of the disc 40 can also be formed directly on the base plate 28, for example, by forming a mold around the base plate 28, positioning abrasive particles 52 on the base plate, and then pouring or spray coating molten metal into the mold until the desired height of the disc is reached with the abrasive particles 52 firmly embedded therein.

The abrasive particles 52 of the disc 40 are selected of a material that has a hardness value that is higher than the hardness of the material of the polishing pad or polishing slurry particles. For a polishing pad of polyurethane that is used with a slurry comprising alkaline or acidic solution, a suitable hardness of the abrasive particles is at least about 5 Mohs. Commonly used abrasive particles 52 include diamond crystals, which may be industrially grown, and have a hardness of about 10 Mohs. For example, the abrasive disc 24 can comprise at least about 60% by volume of diamond or even at least about 90% by volume of diamond, with the remainder composed of the supporting matrix 54 around the particles 52. The abrasive particles 52 can also be other hard materials, such as diamond-like materials such as those formed by the microwave decomposition of carbon-containing gases, $C_3N_4$, or hard phases of boron carbide crystals having cubic or hexagonal structures, as for example, taught by U.S. Pat. Nos. 3,743,489 and 3,767,371, both of which are herein incorporated by reference in their entireties.

Typically, the abrasive particles 52 are selected by size, such a grit size, or weight, to provide a desired level of roughness of the abrasive face 50. The abrasive particles 52 can also be sorted by shape, that is, particles 52 having relatively sharp contours or crystal cleavage faces versus particles having relatively smooth contours. The height of the abrasive particle 52 extending out of the matrix 54 also affects the quality of abrasion provided by the abrasive face 50, for example, an abrasive face 50 having sharply contoured particles extending a relatively large distance out from the surrounding surface would be more abrasive than an abrasive face 50 having particles 52 with rounder faces, or which have exposed portions that extend a smaller distance out from the surrounding surface of the matrix 54. Conventional methods of selecting and sorting the abrasive particles by size or weight have not been able to always provide consistent conditioning attributes. Another method of selecting and sorting abrasive particles is described in commonly assigned U.S. Pat. No. 6,551,176, which is incorporated herein by reference in its entirety.

In one aspect of the present invention, the abrasive face 50 comprises abrasive particles 52 that are selected to have a crystalline structure with substantially the same crystal symmetry, that is, the particles 52 which have the same crystal symmetry about an axis or cross-sectional plane through the particle. The abrasive particles 52 are selected so that at least about 60%, and more preferably, at least about 90% of the particles 52 have the same crystal symmetry. The particles 52 have the same crystal symmetry when each particle 52 has the same mirror image symmetry about a cross-sectional mirror plane 70 or axis 72 through the particle 52, for example, as shown in FIGS. 2A to 2C. For example, FIG. 2A shows an abrasive particle 52*a* having an octahedral crystal structure in which each side across the mirror plane 70 has substantially the same shape, and more preferably, about the same dimensions from the mirror plane as well. The particle 52*a* also has rotational symmetry about the axes 74*a* and 74*b*, such that the particle has identically shaped faces both above and below the mirror plane 70 when viewed at discrete angular orientations. For example, when the particle 52*a* is rotated a specified number of degrees form a zero degree starting point, for example 90°, about the axis 72*a*, the particle 52*a* exhibits the same shape and size of crystal face to an observer across both sides of the mirror plane 70. FIG. 2B shows a symmetric particle having an octahedral crystal structure that is symmetric about the plane 70*b*, and FIG. 2C shows a symmetric particle having a face centered cubic crystal structure that is symmetric about the plane 70*c*.

The symmetric abrasive particles 52 can be selected or manufactured to meet specific symmetry criteria. The intrinsic hardness of a material is a function of the weakest link of its atomic lattice. For example, in tetrahedral structures, each atom is surrounded by at least four atoms to form the simplest solid tetrahedron, with the tetrahedral bonds extending out to form a three dimension structure that is all strongly bonded to one another and substantially absent weak cleavage planes that would fail to cause breakage of the crystal when subjected to polishing stresses. The crystal structure becomes more symmetric with an increasing number of uniformly arrayed surrounding atoms. For example, industrial abrasive particles 52 comprising industrial diamonds can be manufactured to have symmetric shapes and uniform sizes by maintaining suitable nucleation and crystal growth parameters, such as using spaced apart nucleation sites and setting predefined levels of elevated temperatures and pressures.

Alternatively, the symmetric abrasive particles can also be selected from batches of disparate particles having different shapes as illustrated schematically in FIG. 3. In one suitable selection method, an assortment of abrasive particles 52, such as natural diamonds, is fed through a vibrating sieve 76. The sieve 76 has sieve spacings 77 that are sized to be the desired sizes of abrasive particles 52 to pass through particles having predetermined dimensions. At first, only those particles sized smaller than the sieve spacing 77 and that pass through the sieve spacing are collected, the larger particles remaining on top of the sieve surface. The sieved particles are then again passed over another sieve having a grid size that is smaller than the desired particle size, and this time, the particles remaining on the sieve are collected. This process provides the correct sizes and improves the chances of symmetric particles being found in the collected lot. Thereafter, the collected abrasive particles 52 can be examined visually to select only those particles 52*x* having the desired levels of symmetry and discard the other asymmetric particles 52*y*. A microprocessor based optical system, such as a CCD array linked to a pattern recognition system, can also be used to select symmetric particles having predefined shapes.

After the symmetric abrasive particles 52 are selected or manufactured, they are used to form an abrasive disc 24, such that the symmetry of the particles is exploited. In one fabrication method, each symmetric particle 52 is individually positioned in a grid space 64 of a grid 62, as shown in FIG. 4A. The grid 62 serves to separate the particles 52 and can also serve to orient them so that an axis of symmetry 72 points toward a particular direction, for example, perpendicular to the plane of the planar body 44 of the disc 24 as shown by the arrow 68. For example, if the grid spaces 64 are sized to approximate the cross-sectional width of the particles 52, the particles 52 are more likely to become situated vertically in the grid space 64 so that the tips 74 of the particles are substantially all pointed upward in the direction 68.

The abrasive disc 24 of the pad conditioner 20 can also be formed by embedding or encapsulating the abrasive particles 52, such as the symmetric diamond particles in metal coating formed on the surface of the base plate 28 as shown in FIG. 4B. In the fabrication of this abrasive disc 24, a nickel encapsulant is first mixed with the selected symmetric diamond particles and then applied to the rigid base plate 28. A suitable metal is a brazing alloy and other metals and alloys used in bonding techniques such as diffusion bonding, hot pressing, resistance welding and the like. A brazing alloy includes low melting point metal components that reduce the melting temperature of the metal alloy to a melting temperature that that is typically less than about 400° C. and below the melting temperature of the base plate to which the abrasive disc is being joined. Suitable brazing alloys include nickel based alloys, such as a nickel alloy containing chromium, carbon, and magnesium oxide.

An abrasive disc 24 fabricated according to this method provides more uniform cleaning and conditioning of a polishing pad by providing abrasive particles 52 having the same symmetric shape in different directions. When the symmetric particles 52 positioned in the matrix 54 of the abrasive disc 24 with uniform and periodic spacing between them, the resultant pad conditioner 20 has both aligned and symmetrically positioned particles 52 that provide more uniform and consistent surface abrasion. The symmetric particles 52 also have more accurate spatial positioning because their axes of symmetry 72 are aligned so that the particles 52 exhibit similar or the same crystalline facets, maintained at approximately the same angles, in a particular movement direction across the polishing pad. Thus, when the abrasive face 50 is pressed against and oscillated across the surface of a polishing pad, the pad "sees" crystal faces with similar shapes and sizes along multiple directions facing the symmetric crystal faces of the particles 52, as schematically shown in FIG. 4B. This effect provides better and more uniform conditioning of the polishing pad. Also, the symmetrical particles 52 are more consistent in shape, with less likelihood of variations in crystal faces from one particle to another, which further improves conditioning of the pad. Further, the symmetric particles 52 allow the abrasive disc 24 to be more easily flipped over with the reverse or backside face exposed as a new polishing surface as described below.

Figure 5:
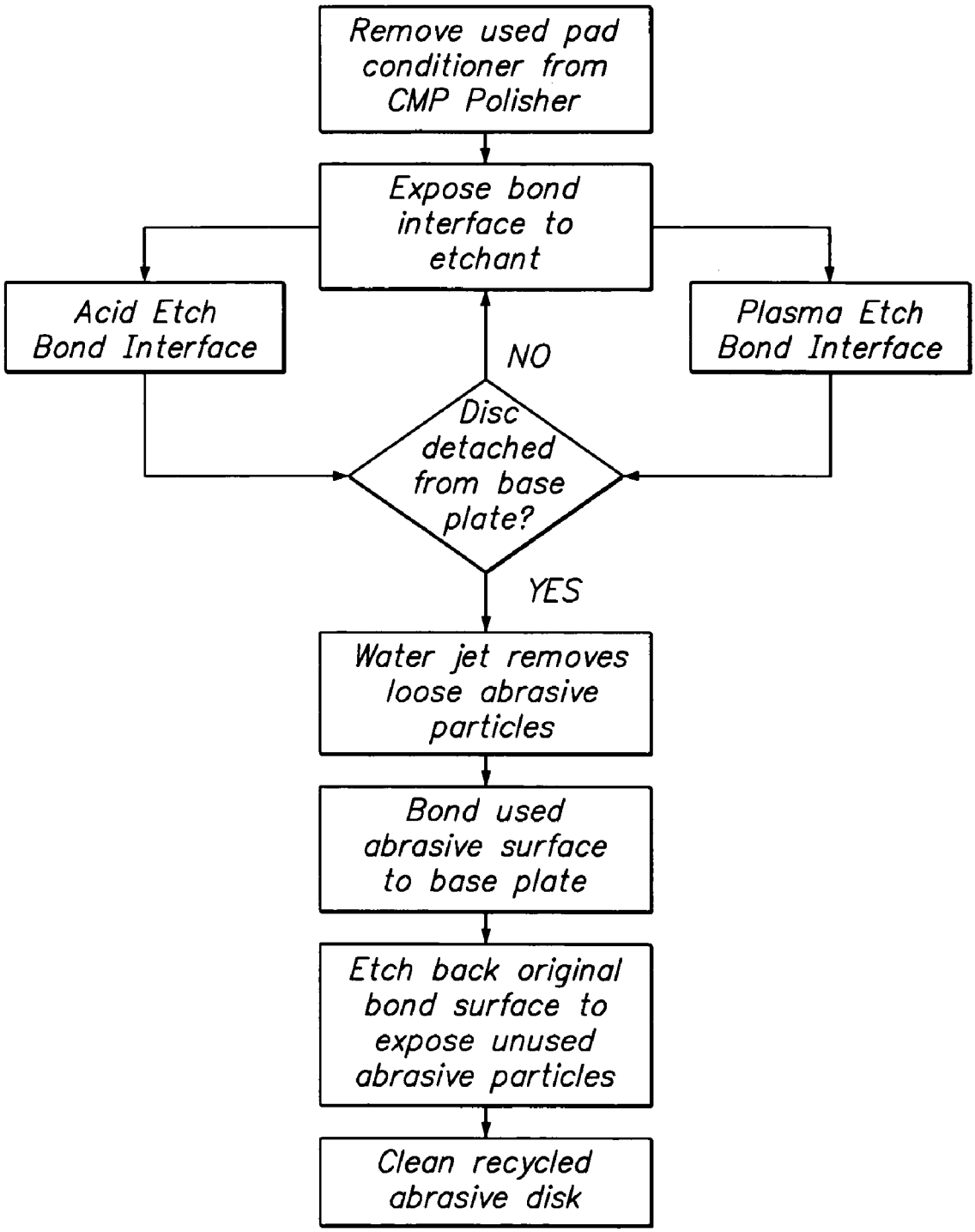
FIG. 5 is a flowchart showing a process for recycling abrasive discs.

In another aspect of the present invention, a used pad conditioner 20*a* can also be refurbished, as illustrated by the steps shown in FIG. 5 and the schematic diagrams of FIG. 6. Initially, a used pad conditioner 20 is removed from a CMP polisher for refurbishment. As shown in FIG. 6A, the used pad conditioner 20*x* has a used abrasive face 50*x* with exposed rounded portions 53*x* of the abrasive particles 52. The used pad conditioner 20*x* is treated to remove the abrasive disc 24 from the base plate 28*x* by exposing the bond interface between the front face 30*x* of the base plate 28 and the bond face 48*x* of the abrasive disc 24 to an etchant that is capable of etching away the bond interface. For example, the pad conditioner 20*x* can be dipped in an etchant solution 80 in a tank 82 to dissolve the bonding material between the abrasive disc 24 and the base plate 28. For example, when the abrasive disc 24 is adhered to the base plate 28*x* with an epoxy adhesive, the adhesive can be removed with an organic solvent—such as acetone; or a plasma of a gas comprising argon, nitrogen, oxygen, carbon monoxide or carbon dioxide. In another example, when the abrasive disc 24 is bonded to the base plate 28*x* with a brazing alloy, a suitable etchant to etch away the alloy can be an acidic solution—such as aqua regia; or a gas plasma comprising $Cl_2$, $BCl_3$ and $CF_4$. The pad conditioner 20*x* is treated with the etchant solution or plasma until the abrasive disc 24*x* detaches from the base plate 28*x*.

Figure 6A:
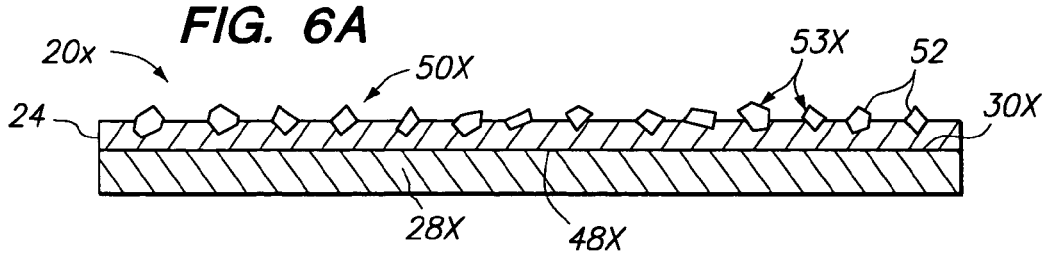
FIG. 6A is a schematic sectional view of a used pad conditioner showing the worn out abrasive particles on the abrasive face of a used pad conditioner.
Figure 6B:
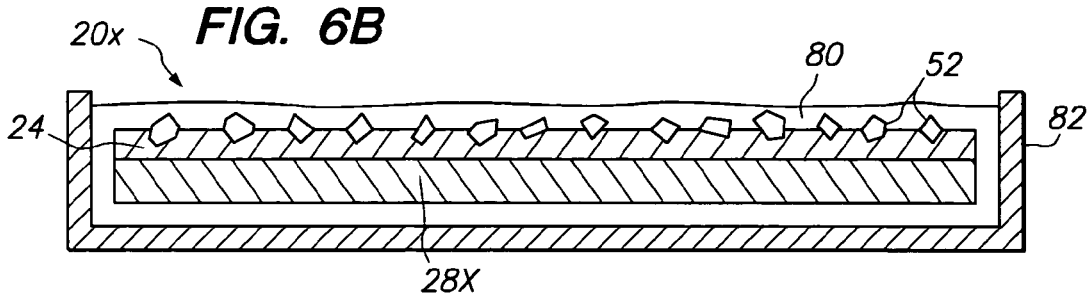
FIG. 6B shows the used pad conditioner of FIG. 6A immersed in a tank of etchant solution.
Figure 6C:
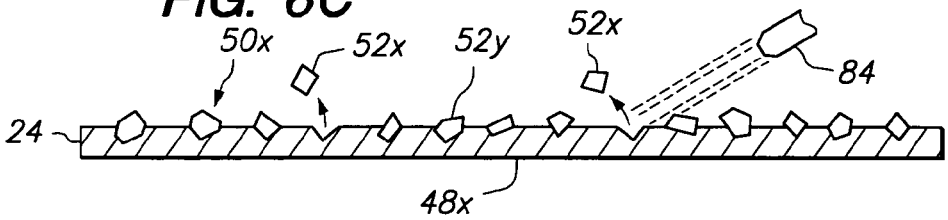
FIG. 6C shows the used abrasive face of the released abrasive disc of the pad conditioner of FIG. 6A being cleaned with a pressurized water jet.

Optionally, a pressurized water jet 84 can be used to clean the used abrasive face 50*x* of the disc 24 so that loose abrasive particles 52*x* on the exposed surface are removed while leaving behind the well adhered particles 52*y*, as shown in FIG. 6C. Removal of the loose particles 52*x* provides a better surface to adhere to a base plate 28 when the used disc 24 is reversed or flipped over. The detached disc 24 is then cleaned using a cleaning solvent, optionally in an ultrasonic bath, and then dried to remove solvent traces from the disc surface.

Figure 6D:
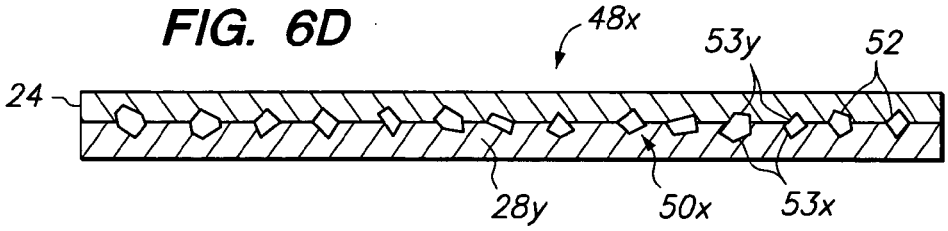
FIG. 6D shows the abrasive disc of FIG. 6A after it is reversed so that the used abrasive face now forms a bond face that is bonded to another base plate to form a recycled pad conditioner assembly.

The used disc 24 is then reversed, or flipped over, so that the used abrasive face 50*x* can be positioned on a base plate, that may be a recycled old base plate 28*x* or a new base plate 28*y*, depending on the condition of the base plate after being exposed to the etchant in the previous step. The used abrasive face 50*x* is placed in contact with the front face of the base plate 28*y* as shown in FIG. 6D, and the two are joined together. A suitable joining method may be spraying or coating the surface of the base plate 28*y* with an epoxy adhesive and then pressing the used abrasive face 50*x* of the abrasive disc 24 to the base plate 28. Another suitable bonding method can use a brazing alloy to braze the abrasive disc 24 to the base plate 28*y*. Brazing is a welding process in which two articles, such as the abrasive disc 24 and the base plate 28, are bonded to one another by heating the joint between the articles to suitable temperatures, typically at least above 400° C., and by using a brazing filler metal having a melting point below that of the base plate 28*y*. The brazing metal distributes itself between the closely fitted surfaces of the interface joint by capillary action.

Figure 6E:
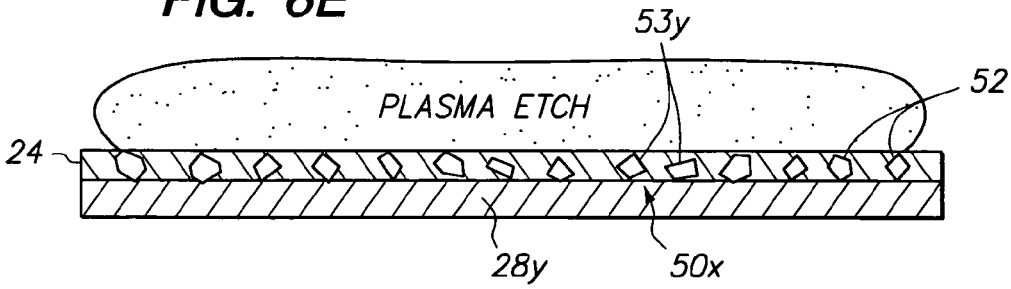
FIG. 6E shows the recycled pad conditioner being etched back in a plasma.
Figure 6F:
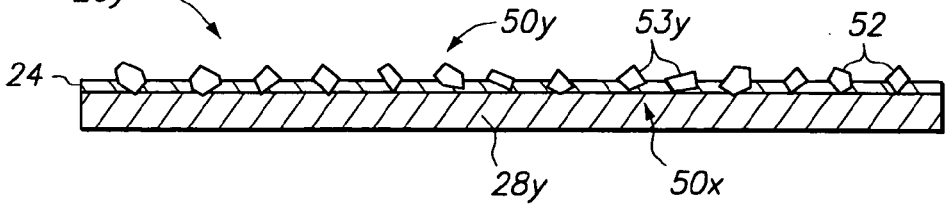
FIG. 6F shows the completed recycled pad conditioner with the used abrasive face now forming the bond face of the abrasive disc and the original bond face etched back to form a new recycled abrasive face.

After the used abrasive disc 24 is joined to the base plate 28*y*, the exposed surface of the abrasive disc 24 can be etched back to expose the underlying or partially exposed unused faces of the abrasive particles 52. The etching back can be performed with a plasma etch, as shown in FIG. 6E, in a plasma etching chamber using conventional etching methods. For example, a suitable plasma to etch an abrasive face comprising nickel alloy comprises a gas composition of a gas plasma comprising $Cl_2$, $BCl_3$ and $CF_4$, maintained in the chamber at a pressure of about 10 to 500 mTorr, with electrodes or an antenna supplied with a gas energizing RF energy of 50 to 1000 watts, in for example a DPS-type etching apparatus fabricated by Applied Materials, Santa Clara, Calif. After etching, the previous bond surface 48*x* now becomes a recycled abrasive face 50*y* for the recycled pad conditioner 20*y*. Fresh crystal faces 53*y* of the abrasive particles 52 are now exposed and the used and worn abrasive particle faces 53*x* are buried in the bond face 48 of the recycled pad conditioner 20*y* as shown in FIG. 6F.

While the pad conditioner recycling method can be used to recycle any type of pad conditioner, further advantages result from having an abrasive disc with the symmetric abrasive particles 52. When symmetric abrasive particles are used, the reversed or flipped over side of the abrasive disc 24 has abrasive particles 52 with the same type of crystal shape extending out of the disc 24, since the particles 52 are symmetric in shape across both sides of the mirror plane bisecting the particle. So even when the particle 52 is flipped over in reversed disc 24, the same shape extends out of the disc as that extending out of the original abrasive face of the disc. This provides a more consistent recycled product that has the same physical attributes, and consequently, the same conditioning effect, as the original disc product.

Figure 7:
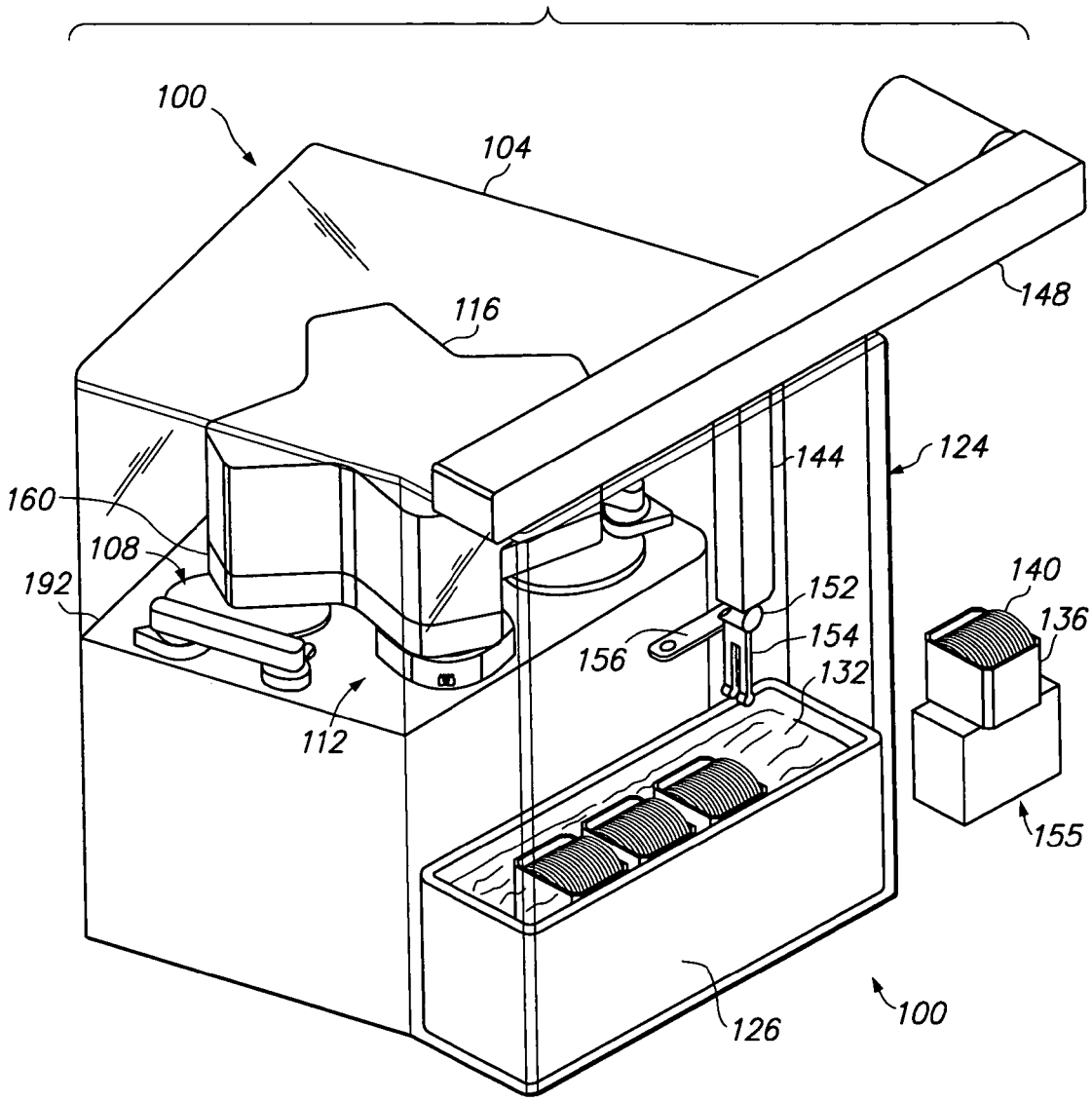
FIG. 7 is a perspective view of a CMP polisher.
Figure 8A:
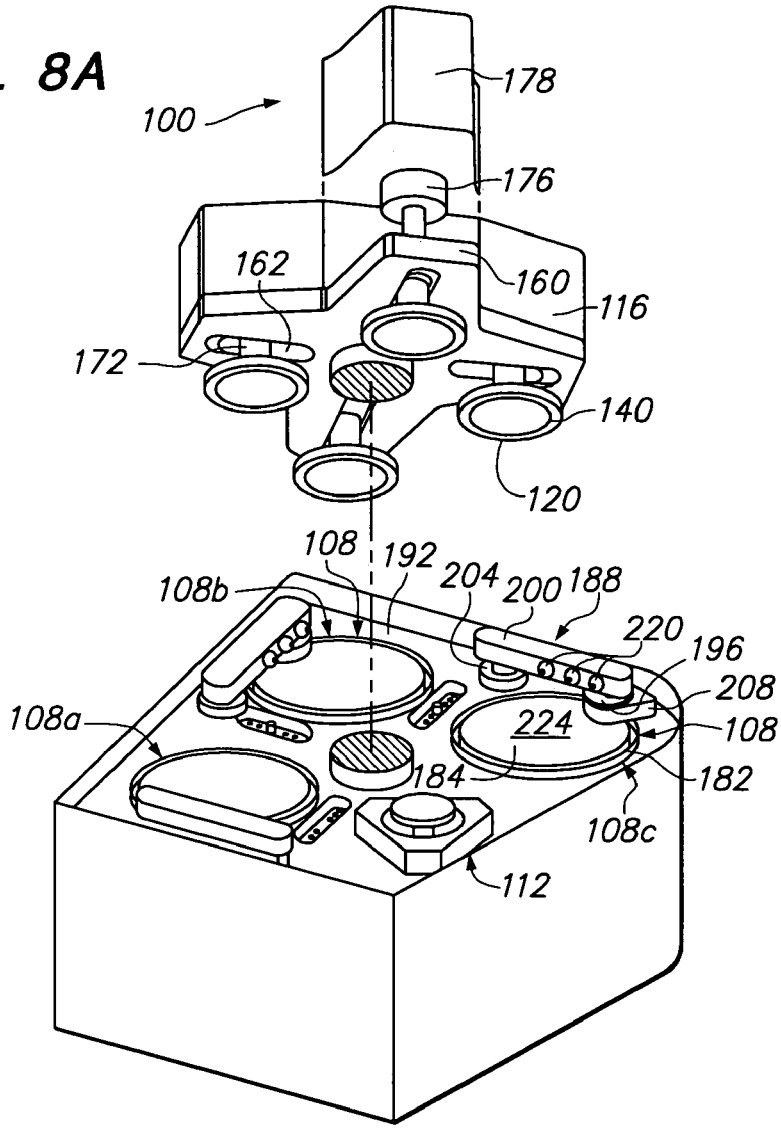
FIG. 8A is a partially exploded perspective view of the CMP polisher of FIG. 7.
Figure 8B:
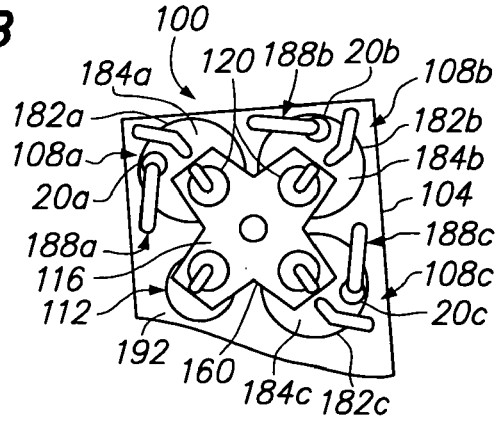
FIG. 8B is a diagrammatic top view of the CMP polisher of FIG. 8B.

The pad conditioner 20 described herein can be used in any type of CMP polisher; thus, the CMP polisher described herein to illustrate use of the pad conditioner 20 should not be used to limit the scope of the present invention. One embodiment of a chemical mechanical polishing (CMP) apparatus 100 capable of using the pad conditioner is illustrated in FIGS. 7, 8A and 8B. Generally, the polishing apparatus 100 includes a housing 104 containing multiple polishing stations 108*a–c*, a substrate transfer station 112, and a rotatable carousel 116 that operates independently rotatable substrate holders 120. A substrate loading apparatus 124 includes a tub 126 that contains a liquid bath 132 in which cassettes 136 containing substrates 140 are immersed, is attached to the housing 104. For example, the tub 126 can include cleaning solution or can even be a megasonic rinsing cleaner that uses ultrasonic sound waves to clean the substrate 140 before or after polishing, or even an air or liquid dryers. An arm 144 rides along a linear track 148 and supports a wrist assembly 152, which includes a cassette claw 154 for moving cassettes 136 from a holding station 155 into the tub 126 and a substrate blade 156 for transferring substrates from the tub 126 to the transfer station 112.

The carousel 116 has a support plate 160 with slots 162 through which the shafts 172 of the substrate holders 120 extend as shown in FIGS. 8A and 8B. The substrate holders 120 can independently rotate and oscillate back-and-forth in the slots 162 to achieve a uniformly polished substrate surface. The substrate holders 120 are rotated by respective motors 176, which are normally hidden behind removable sidewalls 178 of the carousel 116. In operation, a substrate 140 is loaded from the tub 126 to the transfer station 112, from which the substrate is transferred to a substrate holder 120 where it is initially held by vacuum. The carousel 116 then transfers the substrate 140 through a series of one or more polishing stations 108*a–c* and finally returns the polished substrate to the transfer station 112.

Each polishing station 108*a–c* includes a rotatable platen 182*a–c*, which supports a polishing pad 184*a–c*, and a pad conditioning assembly 188*a–c*, as shown in FIG. 8B. The platens 182*a–c* and pad conditioning assemblies 188*a–c* are both mounted to a table top 192 inside the polishing apparatus 100. During polishing, the substrate holder 120 holds, rotates, and presses a substrate 140 against a polishing pad 184*a–c* affixed to the rotating polishing platen 182, which also has a retaining ring encircling the platen 182 to retain a substrate 140 and prevent it from sliding out during polishing of the substrate 140. As a substrate 140 and polishing pad 184*a–c* are rotated against each other, measured amounts of a polishing slurry of, for example, deionized water with colloidal silica or alumina, are supplied according to a selected slurry recipe. Both the platen 182 and the substrate holder 120 can be programmed to rotate at different rotational speeds and directions according to a process recipe.

Each polishing pad 184 typically has multiple layers made of polymers, such as polyurethane, and may include a filler for added dimensional stability, and an outer resilient layer. The polishing pad 184 is consumable and under typical polishing conditions is replaced after about 12 hours of usage. Polishing pads 184 can be hard, incompressible pads used for oxide polishing, soft pads used in other polishing processes, or arrangements of stacked pads. The polishing pad 184 has surface grooves to facilitate distribution of the slurry solution and entrap particles. The polishing pad 184 is usually sized to be at least several times larger than the diameter of a substrate 140, and the substrate is kept off-center on the polishing pad 184 to prevent polishing a non-planar surface onto the substrate 140. Both the substrate 140 and the polishing pad 184 can be simultaneously rotated with their axes of rotation being parallel to one another, but not collinear, to prevent polishing a taper into the substrate. Typical substrates 140 include semiconductor wafers or displays for the electronic flat panels.

Figure 9:
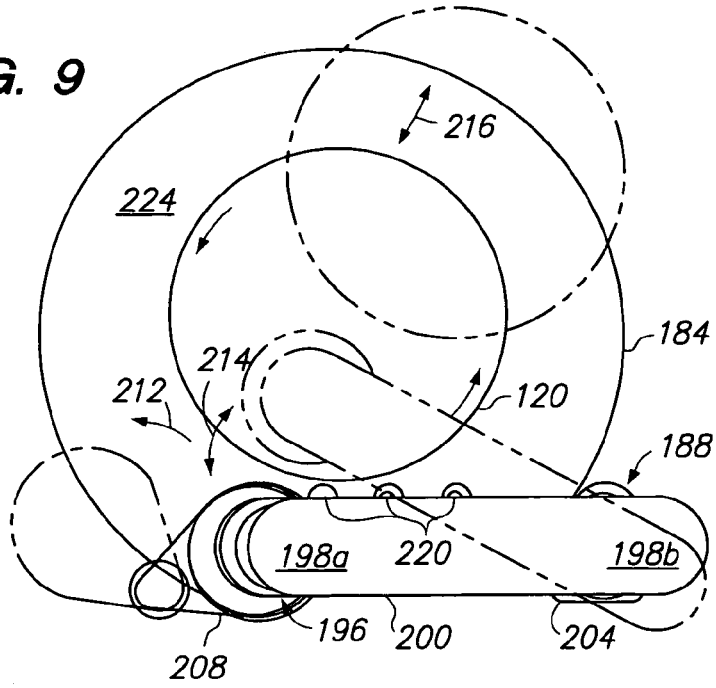
FIG. 9 is a diagrammatic top view of a substrate being polished and a polishing pad being conditioned by the CMP polisher of FIG. 7.
Figure 10:
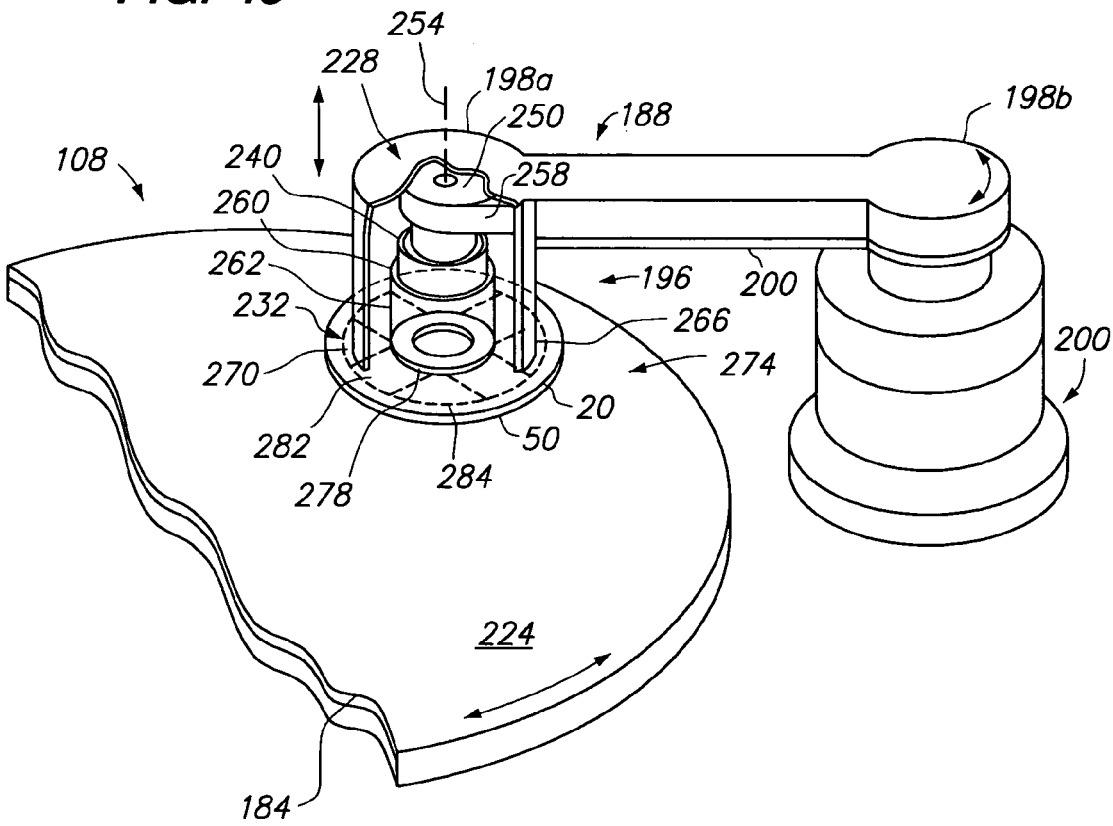
FIG. 10 is a perspective partial cutaway view of a conditioning head assembly of the CMP polisher of FIG. 7 as it is conditioning a polishing pad.

Each pad conditioning assembly 188 of the CMP apparatus 100 includes a conditioner head 196, an arm 200, and a base 204, as shown in FIGS. 9 and 10. A pad conditioner 20 is mounted on the conditioner head 196. The arm 200 has a distal end 198*a* coupled to the conditioner head 196 and a proximal end 198*b* coupled to the base 204, which sweeps the conditioner head 196 across the polishing pad surface 224 so that the abrasive face 50 of the pad conditioner 20 conditions the polishing surface 224 of the polishing pad 184 by abrading the polishing surface to remove contaminants and retexturize the surface. Each polishing station 108 also includes a cup 208, which contains a cleaning liquid for rinsing or cleaning the pad conditioner 20 mounted on the conditioner head 196.

During the polishing process, a polishing pad 184 can be conditioned by a pad conditioning assembly 188 while the polishing pad 184 polishes a substrate mounted on a substrate holder 120. The pad conditioner 20 has an abrasive disc 24 that has an abrasive face 50 with abrasive particles 52 which are used to condition the polishing pad 184. In use, the abrasive face 50 of the disc 24 is pressed against a polishing pad 184, while rotating or moving the pad or disc along an oscillating or translatory pathway. The conditioner head 196 sweeps the pad conditioner 20 across the polishing pad 184 with a reciprocal motion that is synchronized with the motion of the substrate holder 120 across the polishing pad 184. For example, a substrate holder 120 with a substrate to be polished may be positioned in the center of the polishing pad 184 and conditioner head 196 having the pad conditioner 20 may be immersed in the cleaning liquid contained within the cup 208. During polishing, the cup 208 may pivot out of the way as shown by arrow 212, and the pad conditioner 20 of the conditioner head 196 and the substrate holder 120 carrying a substrate may be swept back-and-forth across the polishing pad 184 as shown by arrows 214 and 216, respectively. Three water jets 220 may direct streams of water toward the slowly rotating polishing pad 184 to rinse slurry from the polishing or upper pad surface 224 while a substrate 120 is being transferred back. The typical operation and general features of the polishing apparatus 100 are further described in commonly assigned U.S. Pat. No. 6,200,199 B1, filed Mar. 31$^{st}$, 1998 by Gurusamy et al., which is hereby incorporated by reference herein in its entirety.

Referring to FIG. 10, the conditioner head 196 includes an actuation and drive mechanism 228 that rotates an end effector 232 carrying the pad conditioner 20 about a central vertically-oriented longitudinal axis 254 of the head. The actuation and drive mechanism further provides for the movement of the end effector 232 and the pad conditioner 20 between an elevated retracted position and a lowered extended position (as shown) in which the lower surface 50 of the pad conditioner 20 is engaged with the polishing surface 224 of the pad 184. The actuation and drive mechanism 228 includes a vertically-extending drive shaft 240 which may be formed of heat treated 440C stainless steel, and which terminates in an aluminum pulley 250. The pulley 250 is secured carries a belt 258 which extends along the length of the arm 200 and is coupled to a remote motor (not shown) for rotating the shaft 240 about the longitudinal axis 254. A stainless steel collar, having upper and lower pieces 260 and 262, respectively, are coaxial to the drive shaft 240. The shaft, pulley, and collar form a generally rigid structure which rotates as a unit about the longitudinal axis 254. A generally-annular drive sleeve 266 of stainless steel couples the end effector 232 to the drive shaft 240, and allows the application of a hydraulic pressure or air pressure to the pad conditioner holder 274. The drive shaft 240 transmits torque and rotation from the pulley to the sleeve 266 and a bearing may be interposed therebetween (not shown).

An optional removable pad conditioner holder 274 may intervene between the pad conditioner 20 and the backing plate 270, as shown in FIG. 10. Extending radially outward from a hub 278 are four generally flat sheet-like spokes 282 having distal ends that are secured to an annular rim 284. The spokes 282 are resiliently flexible upward and downward so as to permit tilting of the rim, relative to the axis 254 from the otherwise neutral horizontal orientation, while they are substantially inflexible transverse to the axis 254, so that they effectively transmit torque and rotation about the axis 254 from the hub 278 to the rim 284. Below the spokes, the backing plate includes a rigid, generally disc-shaped, polyethylene terepthalate (PET) plate 270 that extends radially outward. A pad conditioner 20 may be mounted on a pad conditioner holder 274 by screws or a cylindrical magnet that is located in a matching cylindrical bore of the holder 274.

In operation, the conditioner head 196 is positioned above the polishing pad 20 as described above, and the drive shaft 240 is rotated causing rotation of pad conditioner 20. The end effector 232 is then shifted from the retracted position to an extended position to bring the abrasive face 50 of the pad conditioner 20 into engagement with the polishing surface 224 of the polishing pad 184. The downward force compressing the pad conditioner 20 against the pad 184 may be controlled by modulating a hydraulic or air pressure applied within the drive sleeve 266. The downward force is transmitted through the drive sleeve 266, the hub 278, the backing plate 270, to the pad conditioner holder 274, and then to the pad conditioner 20. Torque to rotate the pad conditioner 20 relative to the polishing pad 184 is supplied from the drive shaft 240 to the hub 278, the spokes 282, the rim 284 of the backing plate 270, the pad conditioner holder 274, and then to the pad conditioner 20. The lower surface of the rotating pad conditioner 20, in engagement with the polishing surface of the rotating polishing pad 184, is reciprocated in a path along the rotating polishing pad as described above. During this process, the abrasive face 50 of the pad conditioner 20 is immersed in the thin layer of a polishing slurry atop the polishing pad 184.

For cleaning the pad conditioner 20, the end effector is raised, causing the pad conditioner to disengage from the polishing pad. The cup 208 may then be pivoted to a location below the head and the end effector extended so as to immerse the pad conditioner 20 in a cleaning liquid in the cup (not shown). The pad conditioner 20 is rotated about the axis 254 within the body of cleaning liquid (the rotation need not have been altered since the pad conditioner was engaged to the pad). The rotation causes a flow of the cleaning liquid past the abrasive polishing pad 20 to clean the pad conditioner of contaminants including material worn from the pad, byproducts of the polishing etc.

The aforementioned versions of the pad conditioner 20 uniformly roughen the polishing surface 224 of a polishing pad 184 as the surface 224 gradually smoothens down from repeated polishing. The pad conditioner 20 also keeps the surface 224 of the pad 184 more level when the pattern of sweep and head pressure causes uneven wear of a polishing pad 184. The surface 224 is maintained smooth by grinding down the high uneven areas of the pad 184. The symmetric abrasive particles 52 of the pad conditioner 20 improve the uniformity of conditioning across the polishing surface 224 of the pad by providing more consistent abrasion rates because of the more uniform shape and symmetry of the abrasive particles 52. The pad conditioners 20 also provide more consistent and reproducible results from one pad conditioner 20 to another since pad conditioners with similar shapes of abrasive particles 52 produce better and more uniform conditioning rates.

The present invention has been described with reference to certain preferred versions thereof; however, other versions are possible. For example, the apd conditioner can be used in other types of applications, as would be apparent to one of ordinary skill, for example, as a sanding disc. Other configurations of the CMP polisher can also be used. Further, alternative steps equivalent to those described for the recycling method can also be used in accordance with the parameters of the described implementation, as would be apparent to one of ordinary skill. For example, the etch back step can be eliminated should the recycled pad conditioner exhibit good crystalline faces with uniform heights without etch back, or substituted with another step of removing excess matrix material from the abrasive face of the pad. Therefore, the spirit and scope of the appended claims should not be limited to the description of the preferred versions contained herein.

What is claimed is:

1. A recycled polishing pad conditioner comprising:

(a) a base plate; and (b) a reversed abrasive disc comprising:

(i) an exposed abrasive face having an unused abrasive face with abrasive particles; and (ii) a bond face affixed to the base plate, the bond face comprising a used abrasive face that was previously used to condition polishing pads.

2. A pad conditioner according to claim 1 wherein the exposed abrasive face is at least partially etched back.

3. A pad conditioner according to claim 2 wherein the abrasive particles are embedded in a matrix comprising a grid.

4. A pad conditioner according to claim 2 wherein the abrasive particles are embedded in a matrix comprising a brazing alloy.

5. A pad conditioner according to claim 1 wherein at least about 60% of the abrasive particles have crystalline structures with substantially the same crystal symmetry.

6. A pad conditioner according to claim 5 wherein the abrasive particles comprise diamond particles or diamond-like structures.

7. A pad conditioner according to claim 6 wherein the exposed abrasive face comprises exposed portions of the diamond particles that have a hidden portion that forms the bond face.

8. A chemical mechanical apparatus comprising the pad conditioner of claim 1, and further comprising:

(i) a polishing station comprising a platen to hold a polishing pad, a substrate holder to hold a substrate against the polishing pad, a drive to power the platen or substrate holder, and a slurry dispenser to dispense slurry on the polishing pad;

(ii) a conditioner head to receive the pad conditioner of claim 1; and (iii) a drive to power the conditioner head so that the abrasive face of the pad conditioner can be rubbed against the polishing pad to condition the pad.

9. A method of recycling a used polishing pad conditioner, the pad conditioner comprising a base plate, and an abrasive disc having (i) a bond surface bonded to the base plate, and (ii) an used abrasive face that was previously used to condition polishing pads, the method comprising:

(a) removing the abrasive disc from the base plate;

(b) reversing the abrasive disc to expose the original bond surface of the disc;

(c) bonding the used abrasive face to the base plate; and (d) exposing the unused abrasive particles on the original bond surface to form a fresh abrasive face on a recycled pad conditioner.

10. A method according to claim 9 wherein (a) comprises etching away the bond between the abrasive disc and base plate.

11. A method according to claim 9 wherein (d) comprises etching away a portion of the bond surface to expose the unused abrasive particles.

12. A polishing pad conditioner comprising:

(a) a base plate; and (b) an abrasive disc comprising:

(i) an abrasive face comprising exposed portions of abrasive particles, wherein at least about 60% of the abrasive particles have a crystalline structure with substantially the same crystal symmetry; and (ii) a bond face affixed to the base plate.

13. A pad conditioner according to claim 12 wherein at least about 90% of the abrasive particles have a crystalline structure with substantially the same crystal symmetry.

14. A pad conditioner according to claim 12 wherein the abrasive particles have a crystalline structure with substantially the same crystal symmetry about an axis or cross-sectional plane though the particle.

15. A pad conditioner according to claim 14 wherein the abrasive particles have mirror image symmetry about a cross-sectional mirror plane.

16. A pad conditioner according to claim 12 wherein the abrasive particles are diamond-like structures.

17. A pad conditioner according to claim 12 wherein the abrasive particles comprise diamond particles.

18. A pad conditioner according to claim 12 wherein the abrasive particles are embedded in a matrix comprising a grid.

19. A pad conditioner according to claim 12 wherein the abrasive particles are embedded in a matrix comprising a brazing alloy.

20. A chemical mechanical apparatus comprising the pad conditioner of claim 12, and further comprising:

(i) a polishing stations comprising a platen to hold a polishing pad, a substrate holder to hold a substrate against the polishing pad, a drive to power the platen or substrate holder, and a slurry dispenser to dispense slurry on the polishing pad;

(ii) a conditioner head to receive the pad conditioner of claim 12; and (iii) a drive to power the conditioner head so that the abrasive face of the pad conditioner can be rubbed against the polishing pad to condition the pad.

* * * * *